US008549867B2

(12) United States Patent
Crawford et al.

(10) Patent No.: US 8,549,867 B2
(45) Date of Patent: Oct. 8, 2013

(54) HEAT PUMP CONTROL SYSTEM USING PASSIVE DEFROST

(75) Inventors: Carl T. Crawford, Hickory Creek, TX (US); Robert B. Uselton, Plano, TX (US); Bruce Perkins, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 776 days.

(21) Appl. No.: 12/610,527

(22) Filed: Nov. 2, 2009

(65) Prior Publication Data

US 2011/0100041 A1 May 5, 2011

(51) Int. Cl.
*F25D 21/06* (2006.01)
*F25B 13/00* (2006.01)

(52) U.S. Cl.
USPC ..... 62/156; 62/155; 62/160; 62/196.3; 62/234; 62/278

(58) Field of Classification Search
USPC ..... 62/151, 155, 156, 160, 196.1, 196.3, 62/234, 277, 278
See application file for complete search history.

(56) References Cited

U.S. PATENT DOCUMENTS 4,158,950 A * 6/1979 McCarty ..... 62/278
4,346,565 A * 8/1982 McCarty ..... 62/151
4,346,566 A * 8/1982 McCarty et al. ..... 62/159
5,269,151 A * 12/1993 Dinh ..... 62/81

* cited by examiner

*Primary Examiner* — Marc Norman

(57) ABSTRACT

A heat pump system includes a controller and a closed system that includes a condensing heat exchanger coil, an evaporating heat exchanger coil, a refrigerant and a compressor. The compressor is configured to compress the refrigerant, thereby causing the refrigerant to have a greater pressure in the condensing heat exchanger coil than in the evaporating heat exchanger coil. The controller is configured to perform a passive defrost of the evaporating heat exchanger coil. The passive defrost includes disabling the compressor and providing a bypass path between the condensing and evaporating heat exchanger coils that bypasses the compressor. The bypass path allows the refrigerant to flow from the condensing heat exchanger coil to the evaporating heat exchanger coil while the compressor is disabled.

20 Claims, 6 Drawing Sheets

HEAT PUMP CONTROL SYSTEM USING PASSIVE DEFROST

TECHNICAL FIELD

This application is directed, in general, to a heat pump and, more specifically, to improving efficiency of operation thereof.

BACKGROUND

A heat pump may be reversibly configured to heat or to cool a climate-controlled space. This dual-role capability may allow the heat pump to replace a separate air conditioner/furnace combination. However, because the heat pump uses electricity for both heating and cooling, efficiency (e.g. HSPF) is of utmost importance.

Under some operating conditions, frost may form on heat exchanger (HX) coil used to extract heat from the environment, typically an outdoor coil. Conventional heat pump systems remove the frost using a reverse-cycle defrost, in which the heat pump runs in a cooling mode to defrost outdoor (OD) HX coils with heat transported from indoor (ID) HX coils. The heat produced by the reverse-cycle defrost is lost to the outdoor ambient thus reducing the efficiency of the heat pump. Moreover, supplemental heat consumed to temper indoor air during the defrost adds further to the energy penalty.

SUMMARY

One aspect provides a heat pump system that includes a closed system and a controller. The closed system includes a condensing HX coil, an evaporating HX coil, a refrigerant and a compressor. The compressor is configured to compress the refrigerant, thereby causing the refrigerant to have a greater pressure in the condensing HX coil than in the evaporating HX coil. The controller is configured to perform a passive defrost of the evaporating HX coil. The passive defrost includes disabling the compressor and providing a low-resistance bypass path between the condensing and evaporating HX coils that bypasses the compressor. The bypass path allows the refrigerant to flow from the condensing HX coil to the evaporating HX coil while the compressor is disabled.

Another aspect provides a method of manufacturing a heat pump. The method includes configuring a compressor and a controller. The compressor is configured to compress a refrigerant, thereby causing a pressure differential between the refrigerant in a condensing HX coil and in an evaporating HX coil. The controller is configured to perform a passive defrost of the evaporating HX coil. The passive defrost includes disabling the compressor and providing a low-resistance bypass path between the condensing and evaporating HX coils that bypasses the compressor. The bypass path allows the refrigerant to flow from the condensing HX coil to the evaporating HX coil while the compressor is disabled.

In yet another embodiment, a controller is configured to control operation of a heat pump. The controller implements a method that includes compressing a refrigerant with a compressor. The compressing causing a pressure differential between the refrigerant in a condensing HX coil and in an evaporating HX coil. The method further includes performing a passive defrost of the evaporating HX coil. The passive defrost includes disabling the compressor and providing a low-resistance bypass path between the condensing and evaporating HX coils that bypasses the compressor. The bypass path allows the refrigerant to flow from the condensing HX coil to the evaporating HX coil while the compressor is disabled.

BRIEF DESCRIPTION

Reference is now made to the following descriptions taken in conjunction with the accompanying drawings, in which.

DETAILED DESCRIPTION

The disclosure recognizes that frost may be removed from a heat exchanger (HX) coil of a heat pump system by using a "passive defrost" operation, generally referred to herein simply as a passive defrost. The passive defrost takes advantage of residual heat energy stored during normal operation of the heat pump system in a region that includes a condensing HX coil having higher pressure than the frosted coil. The compressor is disabled, and the refrigerant is allowed to redistribute to the frosted coil under the influence of the pressure differential. The residual heat may melt the frost, after which conventional operation of the heat pump system may resume. The passive defrost advantageously provides greater efficiency of overall operation of the heat pump system relative to conventional systems. In some cases, greater comfort to occupants of a heated space may also result.

The following abbreviations are defined as indicated below in this description and in the claims:

ID: Indoor
OD: Outdoor
HX: Heat Exchanger
OAT: Outside Air Temperature
MRT: Minimum Reset Temperature The following discussion describes various embodiments in the context of heating an indoor ambient, such as a residential living area. Such applications are often referred to in the art as HVAC (heating-ventilating and air conditioning). Heat is described in various embodiments as being extracted from an outdoor ambient. Such references do not limit the scope of the disclosure to use in HVAC applications, nor to residential applications. As will be evident to those skilled in the pertinent art, the principles disclosed may be applied in other contexts with beneficial results, including without limitation mobile and fixed refrigeration applications. For clarity, embodiments in the following discussion may refer to heating a residential living space without loss of generality.

Figure 1:
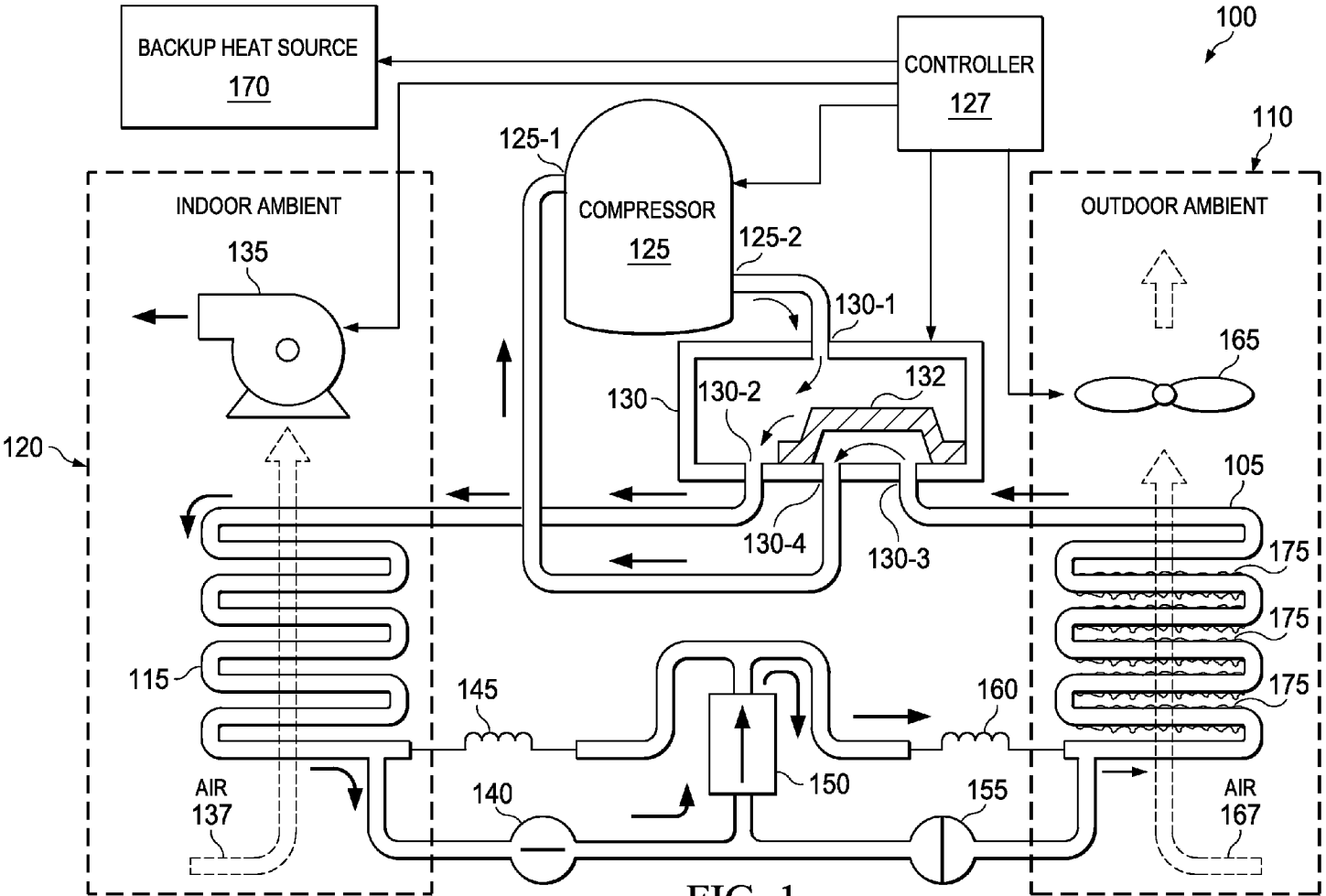
FIG. 1 is a block diagram of a heat pump system of the disclosure operating to transport heat from an outdoor ambient to an indoor ambient.

Referring initially to FIG. 1, illustrated is a block diagram of a heat pump system 100 according to the disclosure. The system 100 may be used in, e.g., residential/commercial HVAC, retail grocery refrigerators (such as those used in grocery stores), refrigerated warehouses, domestic refrigeration and refrigerated transport. The system 100 includes an outdoor (OD) HX coil 105 in an OD ambient 110, and an indoor (ID) HX coil 115 in an ID ambient 120. In the heating mode the OD HX coil 105 acts as an evaporating coil that extracts heat from the OD ambient 110, and the ID HX coil 115 acts as a condensing coil that releases heat to the ID ambient 120. In cooling mode, the roles of the HX coils 105, 115 are reversed.

The system 100 as illustrated is configured to operate in a "pumped heating mode," e.g. to transport heat from the OD HX coil 105 to the ID HX coil 115. Conceptually, in this mode the OD ambient 110 may be viewed as a heat source, and the ID ambient 120 may be viewed as a heat sink. When the system 100 is configured to operate in a "cooling mode," e.g. to transport heat from the ID HX coil 115 to the OD HX coil 105, the ID ambient 120 is the heat source and the OD ambient 110 is the heat sink.

The operation of the system 100 in the configuration of FIG. 1 is now described in the context of the pumped heating mode without limitation to a particular application thereof. A compressor 125 includes an input port 125-1 and an output port 125-2. The compressor 125 and the HX coils 105, 115 form a closed system that includes a refrigerant. The compressor 125 pressurizes the refrigerant, which then flows to a flow valve 130.

A controller 127 controls the operation of the components of the system 100, including the compressor 125. The controller 127 may include any combination of electronic, mechanical and electro-mechanical components configured to control the components of the system 100 within the scope of the disclosure. Non-limiting examples of components include microprocessors, microcontrollers, state machines, relays, transistors, power amplifiers and passive electronic devices.

The flow valve 130 is illustrated without limitation as a reversing slide valve. The following description is presented without limitation for the case that the flow valve 130 is a reversing slide valve. While a reversing slide valve may be beneficially used in various embodiments of the disclosure, those of ordinary skill in the pertinent arts will appreciate that similar benefit may be obtained by alternate embodiments. Embodiments discussed below expand on this point.

The flow valve 130, consistent with the construction of reversing slide valves, has a sliding portion 132. In an example embodiment, without limitation, the flow valve 130 is a Ranco type V2 valve available from Invensys Controls, Carol Stream, Ill., USA. The flow valve 130 includes four ports 130-1, 130-2, 130-3, and 130-4. The sliding portion 132 is typically located in one of two positions. In a first position, as illustrated in FIG. 1, the ports 132-1 and 132-2 are connected, as are the ports 132-3 and 132-4. In the second position, illustrated in FIG. 2 and discussed further below, the ports 132-2 and 132-4 are connected, as are the ports 132-1 and 132-3.

When the compressor 125 is operating, refrigerant flows from the compressor 125 to the ID HX coil 115 via the ports 130-1, 130-2. The refrigerant carries an enthalpy $\Delta H_v$ due to compression, and an enthalpy due to condensation related to the phase change of the refrigerant from gas to liquid. The refrigerant is therefore typically warmer than the ID ambient 120. A blower 135 controlled by the controller 127 moves air 137 over the ID HX coil 115, transferring heat from the refrigerant to the ID ambient 120, thus reducing the temperature of the refrigerant.

The refrigerant flows through a check valve 140 oriented to open in the illustrated direction of flow, causing the refrigerant to bypass a throttle 145. The refrigerant then flows through a filter/drier 150. A check valve 155 is oriented to close in the direction of flow, thus causing the refrigerant to flow through a throttle 160. A portion of the refrigerant vaporizes on the downstream, low pressure side of the throttle 160, thereby cooling according to $\Delta H_v$ and expansion. The cooling of the refrigerant causes the OD HX coil 105 to cool. A fan 165 controlled by the controller 127 moves air 167 over the OD HX coil 105, transferring heat from the OD ambient 110 to the refrigerant. The refrigerant returns to the compressor 125 via the ports 130-3, 130-4 of the flow valve 130, thus completing the refrigeration cycle.

The system 100 may also include an optional backup heat source 170, also controlled by the controller 127. The backup heat source 170 may be conventional or novel, and may be powered by electricity, natural gas, or any other fuel. Operation of the backup heat source 170 is discussed below.

Under some conditions, related to temperature and dew point of the air 167, frost 175 forms on the OD HX coil 105. The frost 175 acts to inhibit heat flow between the OD HX coil 105 and the air 167, reducing the efficiency of the system 100. Therefore, it is generally desirable to remove the frost 175 periodically.

Conventional methods of removing frost include, e.g., a reverse-cycle defrost. The reverse-cycle defrost essentially reconfigures a conventional heat pump system to extract heat from the space that was previously being warmed. In other words, if the system 100 were conventionally configured to melt the frost 175, the system 100 would operate in cooling mode to transfer the heat from the ID ambient 120 to the OD HX coil 105.

However, this conventional defrost operation is undesirable in several respects. First, work is performed transporting heat to the frosted coil. The dissipated heat associated with this work is lost to the ambient, and represents loss of efficiency of the conventional system. Second, when the conventional system is reconfigured from pumped heating mode to cooling mode, pressure changes therein often generate noise that may be unpleasant to some users of the conventional system, e.g., homeowners. And third, the user of the conventional system may find it unpleasant to circulate cold air within a living area during the conventional defrost operation. Electric (resistive) heat may be used to temper the air during the conventional defrost operation, but at the expense of additional energy consumption.

Figure 2:
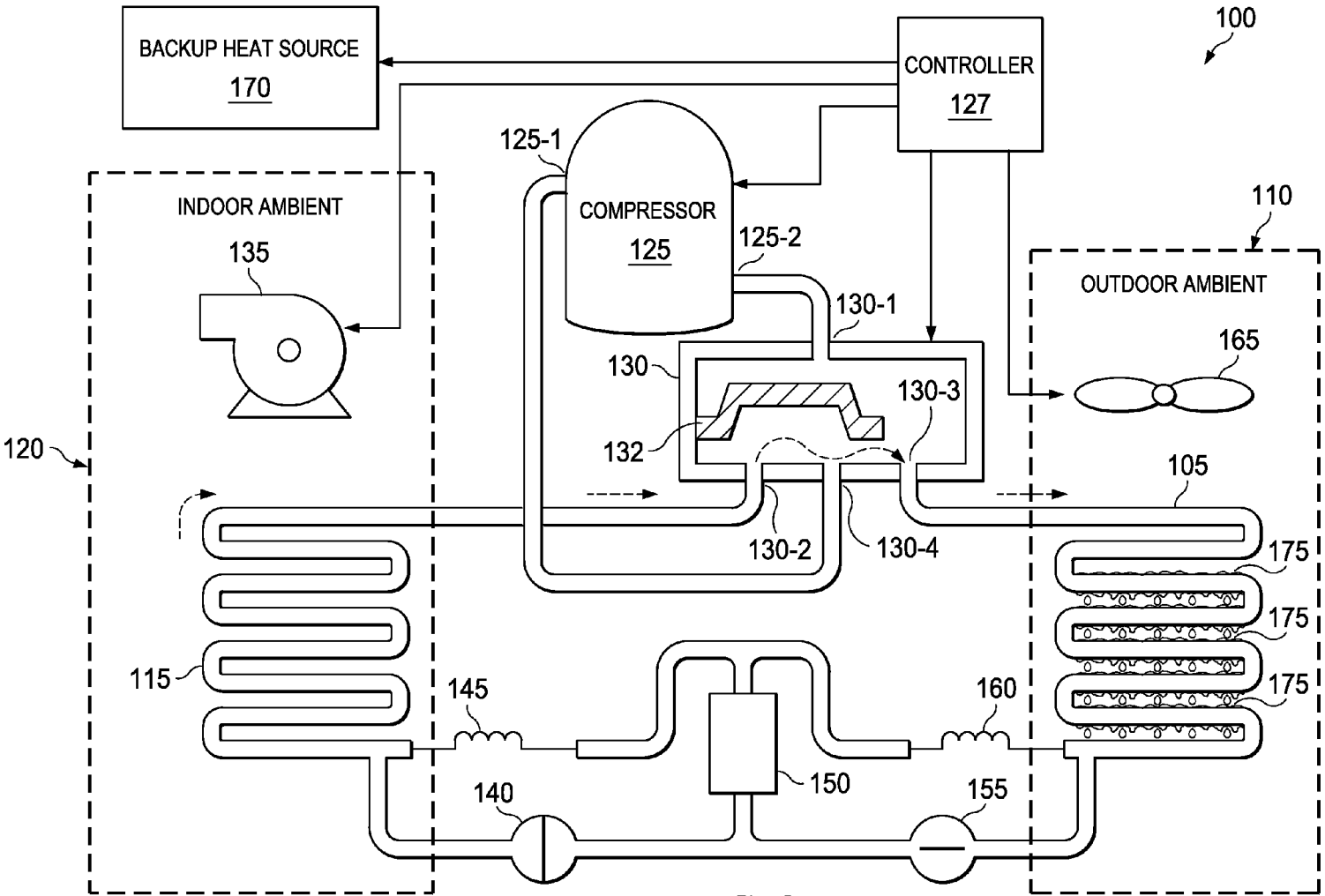
FIG. 2 is a block diagram of the heat pump system operating according to an embodiment of the disclosure, in which refrigerant bypasses a compressor.
Figure 3:
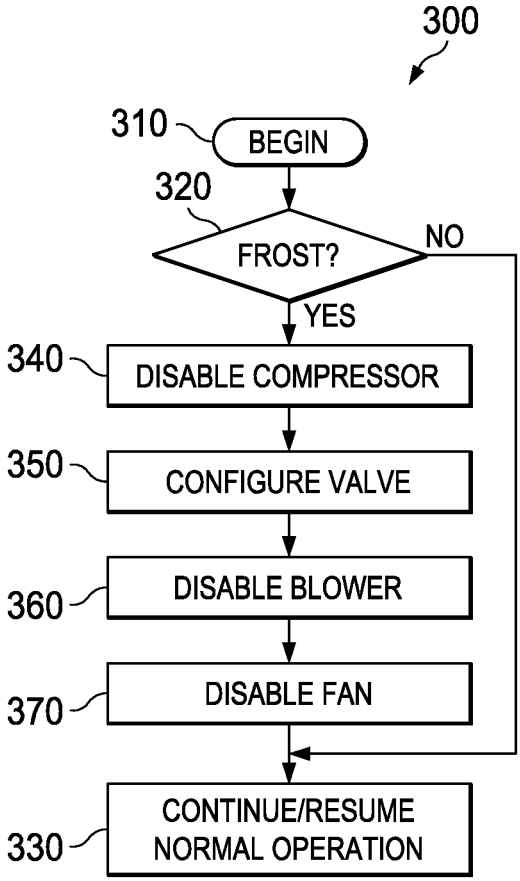
FIG. 3 is a flow diagram of a method of operating a heat pump system according to one embodiment of the disclosure.

Turning to FIG. 2, the system 100 is illustrated as configured according to the disclosure to defrost the OD HX coil 105 in a manner that reduces or eliminates the aforementioned deficiencies of conventional heat pump systems. FIG. 2 is described with concurrent reference to FIG. 3, which presents a flow diagram of a method 300 of operating the system 100. The method 300 begins with a step 310, which may be entered from any appropriate step of otherwise conventional operation of the system 100.

In a step 320, the controller 127 determines if the frost 175 is present. The frost 175 may be detected by any conventional or novel method. Examples of known methods of frost detection include monitoring air flow resistance through an HX coil, or monitoring a temperature profile of the HX coil. In some embodiments, an optical sensor may be used to detect the presence of the frost 175. Various methods may make use of a microprocessor or microcontroller, e.g., to determine when the monitored data indicates sufficient frost 175 is present to trigger a defrost operation.

If insufficient frost 175 is detected in the step 320, the method 300 advances to a step 330, from which the controller 127 continues normal operation. If instead the controller 127 detects the frost 175 in the step 320, the method 300 enters a passive defrost operation by advancing to a step 340. In the step 340, the controller 127 disables the compressor 125. As a result, the refrigerant in the system 100 no longer flows under pressure maintained by the compressor 125.

Herein and in the claims, "disable" or "disabled" means that a source of power to a device is reversibly interrupted to prevent that device from performing its relevant primary function. Thus, for example, when the compressor 125 is disabled it is unable to perform its primary function of pressurizing the refrigerant. Other functionality, e.g., pressure sensing, may continue to operate normally though the compressor 125 is disabled as defined.

In a step 350, the controller 127 reconfigures the flow valve 130 to route the port 130-2 to the port 130-4. The controller 127 may, e.g., cause a solenoid to move the sliding portion 132, or the sliding portion 132 may assume a default position when a solenoid is not energized. The configuration of the flow valve 130 is that used when the system 100 is configured to cool the ID ambient 120, e.g., cooling mode. However, because the compressor 125 is disabled, the flow valve 130 operates differently than it does when the compressor 125 is producing pressure. More specifically, while the compressor 125 is operating, the sliding portion 132 forms a tight seal against a valve seat.

However, without pressure provided by the compressor 125, the sliding portion 132 is allowed to float off the valve seat under the force of the pressure differential between the ID HX coil 115 and the OD HX coil 105: While the system 100 is operating in pumped heating mode, a region of the system 100 that includes the ID HX coil 115 acts as a heat reservoir of refrigerant at high temperature and pressure with respect to the OD HX coil 105. In some cases, the refrigerant in the high pressure region may have a differential pressure of about 1.5-3 MPa or greater with respect to the OD HX coil 105. Thus, the sliding portion 132 floats from the valve seat and refrigerant passes from the port 130-2 to the port 130-3. Such operation of the flow valve 130 is contrary to conventional practice.

The disclosure reflects the recognition that this heat reservoir may be advantageously used to melt frost on an HX coil passively. As used herein, the term "passive defrost" or "passive defrost operation" refers to configuring the system 100 to allow refrigerant to flow from a high pressure region to an evaporating coil under the influence of a residual pressure differential without the aid of a compressor.

This advance is based in part on the heretofore unrecognized implications of the evolution of heat pump technology. For example, certain design considerations in current heat pump systems have resulted in larger HX coils than in the past. Thus, the system 100 includes a greater volume of pressurized refrigerant than past designs. Moreover, changes in refrigerant chemistry, e.g., replacing R-22 with R-410a, have resulted in greater differential pressure between the HX coils. The combination of these factors provides the refrigerant volume and driving force necessary to implement a passive defrost. Furthermore, the state of the art of frost sensing provides the ability to detect the presence of frost in smaller amounts than in the past, reducing the amount of heat needed to melt the accumulated frost.

The compressor 125 typically contains a check valve or similar device to prevent refrigerant from being forced under pressure into the port 125-1. Thus, little if any refrigerant flows through the compressor 125 when the compressor 125 is disabled. In some cases a small amount of refrigerant may pass from the ID HX coil 115 through the throttle 145, but such leakage is expected to be insignificant. To the extent that there is any flow through the throttle 145, such flow should not contribute to the desired warming of the OD HX coil 105, as the refrigerant will expand and cool after passing through the throttle 145.

When configured as illustrated in FIG. 2, the flow valve 130 provides a path with low flow resistance between the ID HX coil 115 and the OD HX coil 105. This path is referred to herein and in the claims as a low-resistance bypass path. The refrigerant flows from the port 130-2 to the port 130-3, flowing between the sliding portion 132 and the valve seat as illustrated by dashed lines indicating the direction of refrigerant flow. Thus, refrigerant bypasses the compressor 125 and flows directly from the ID HX coil 115 to the OD HX coil 105 via the ports 130-2, 130-3.

While flow resistance through the flow valve 130 is generally difficult to quantify a priori due to flow turbulence, e.g., the resistance is expected to be at least a factor of 10 less than other leakage paths through the system 100, e.g. the throttle 145. In some cases, the flow resistance through the flow valve may be 50-100 times less than other leakage paths, e.g., when non-bleed expansion valves are used for the throttles 145, 160. Because any flow through such alternate paths will be very low, and will not contribute significantly to warming the OD HX coil 105, these alternate leakage paths are not bypass paths in this disclosure.

Because the flow resistance through the flow valve 130 is low, the pressure in the OD HX coil 105 can rapidly equilibrate with the pressure in the ID HX coil 115. The temperature of the refrigerant may cool slightly as the pressure equilibrates, but is expected to retain a significant and useful amount of heat energy. Thus, warm refrigerant advantageously flows to the OD HX coil 105 without the expenditure of energy by the compressor 125.

Configuring the system 100 in the manner described advantageously provides sufficient heat in many cases to the OD HX coil 105 to melt the frost 175 without additional components. However, embodiments in which additional components are used are within the scope of the disclosure.

Figure 4:
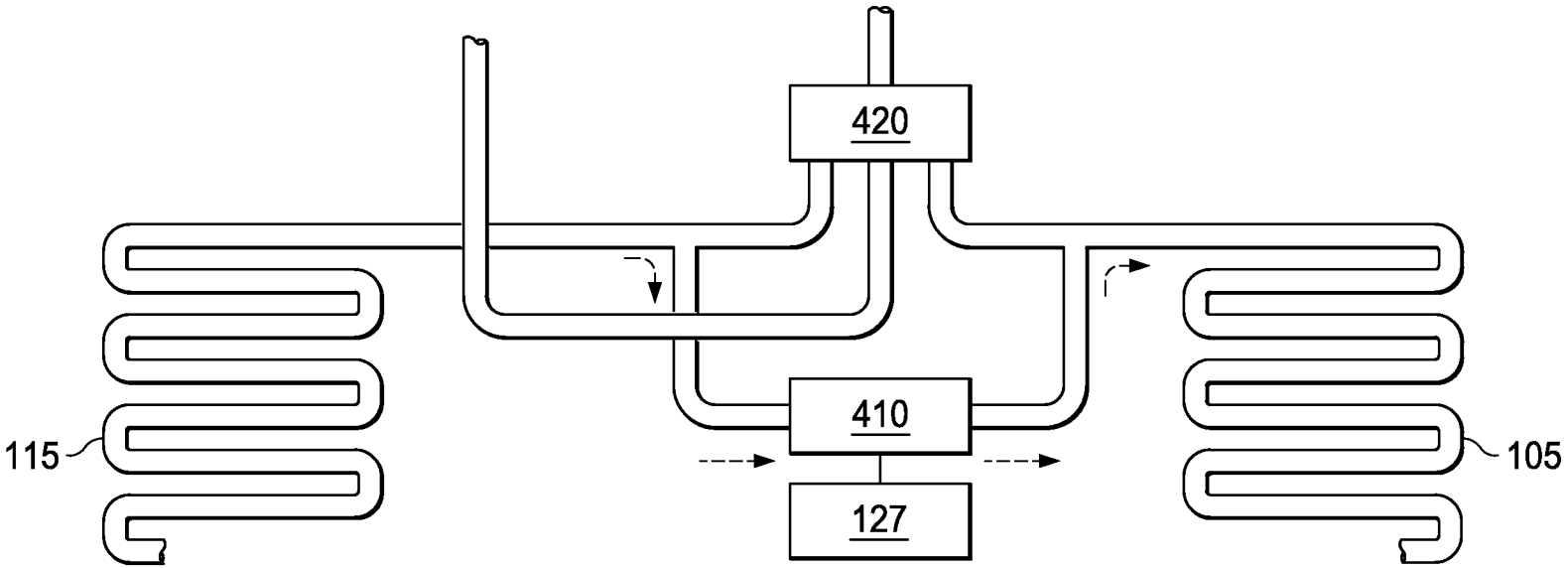
FIG. 4 illustrates an embodiment in which a separate valve provides a bypass path for the refrigerant.

For example, FIG. 4 illustrates an embodiment in which a bypass valve 410 provides a path from the ID HX coil 115 to the OD HX coil 105. The bypass valve 410 may be controlled by the controller 127, e.g. A flow valve 420 may be any suitable reversing valve, e.g., a conventional four-way flow valve or a slide-type flow valve such as the flow valve 130. During normal operation, the bypass valve 410 is closed, resulting in conventional refrigerant flow in both heating and cooling modes as determined by the flow valve 420. During a passive defrost, the valve 410 is opened to provide a low-resistance bypass path from the ID HX coil 115 to the OD HX coil 105, thereby bypassing the compressor 125. While the flow valve 420 is illustrated as separate from the compressor 125, in some embodiments the flow valve 420 is contained within the compressor 125 housing.

Returning to FIG. 2, in some embodiments, the controller 127 initiates a passive defrost operation on a periodic basis. In some cases, the period between subsequent defrost operations may be predetermined to provide sufficient protection against frost accumulation. For example, it may be determined that, e.g., a 2-3 minute defrost operation duration occurring with a period of 30-60 minutes is expected to be effective to remove frost in many cases. Thus, in an alternate embodiment of the method 300, the step 320 may be replaced by a step in which the controller 127 determines if a predetermined period between defrost operations has expired. If the period has expired, then the method 300 advances to the step 340. If not, then the method 300 advances to the step 330 and continues normal operation.

The warm liquid refrigerant stored in the ID HX coil 115 in many cases contains sufficient heat to melt the frost 175, restoring the coils to their desired efficiency. Thus in some embodiments the passive defrost may be terminated when the frost 175 is melted even though the refrigerant may retain additional heat. Normal operation of the system 100 may then be resumed if desired. In other cases, such as for heavy frost accumulation or particularly cold conditions, a single passive defrost cycle may not be sufficient to completely melt the frost 175. In these cases, the passive defrost may be repeated as many times as desired. Repeating the passive defrost may include briefly operating the system 100 in the pumped heating mode to warm and repressurize the refrigerant in the ID HX coil 115.

In one embodiment, a passive defrost operation is performed between heating cycles. A heating cycle is a period of operation of the system 100 in the pumped heating mode, the period ending when a set point temperature of the ID ambient 120 is reached. In another embodiment, the system 100 performs a passive defrost after every heating cycle. For example, after the temperature of the ID ambient 120 reaches a first predetermined set point, the system 100 typically will disable the compressor 125, the blower 135 and the fan 165 until the temperature of the ID ambient 120 drops below a second predetermined set point. The controller 127 may configure the flow valve 130 (or the bypass valve 410) as described above after reaching the first set point, thereby performing the passive defrost operation routinely.

In some embodiments, the controller 127 includes a timer. The timer may be started upon beginning a passive defrost operation. A single passive defrost may have an effective time limit based on the heat available in a single charge of refrigerant passively provided to the OD HX coil 105. In some cases, it may be determined that the frost 175 is removed in a time period less than the effective period of the passive defrost. On the other hand, it may be determined that the effective time period of a passive defrost is less than a time period determined to be needed to remove the frost 175. In such cases, the passive defrost may be repeated any number of times as needed until the expiration of the defrost period. Upon the expiration of the timer, the system 100 re-enables operation of the compressor 125.

Of course, while the system 100 is configured to defrost the OD HX coil 105, the ID ambient 120 may cool down due to, e.g., conductive heat loss to the OD ambient 110. Thus, it is generally preferred to limit the frequency and/or duration of the passive defrost operation to no more than necessary to remove the frost 175. Accordingly, in some embodiments the time between passive defrost operations is calculated by the controller 127 as a function of the temperature (outside air temperature, or OAT) and/or humidity of the OD ambient 110 as determined, e.g., by one or more sensors. In some cases, the time between passive defrost operations may be less for a lower OAT than for a higher OAT, as when the combination of dew point and lower temperature results in greater rate of frost buildup at the lower temperature than at the higher temperature.

The method 300 includes optional steps 360, 370. In the step 360, the controller 127 disables the blower 135. Disabling the blower 135 conserves power and may increase the comfort of an occupant of the ID ambient 120. However, when desired the blower 135 may be operated for any reason, including, e.g., providing supplemental heat from the backup heat source 170. In the step 370, the controller 127 disables the fan 165. While the step 370 is optional, it is expected that generally it will be preferable to disable the fan 165 during the passive defrost when the temperature of the air 167 is below freezing. However, when the temperature of the air 167 is above freezing, it may be preferable to run the fan 165 during the passive defrost to more quickly melt the frost 175.

Figure 5:
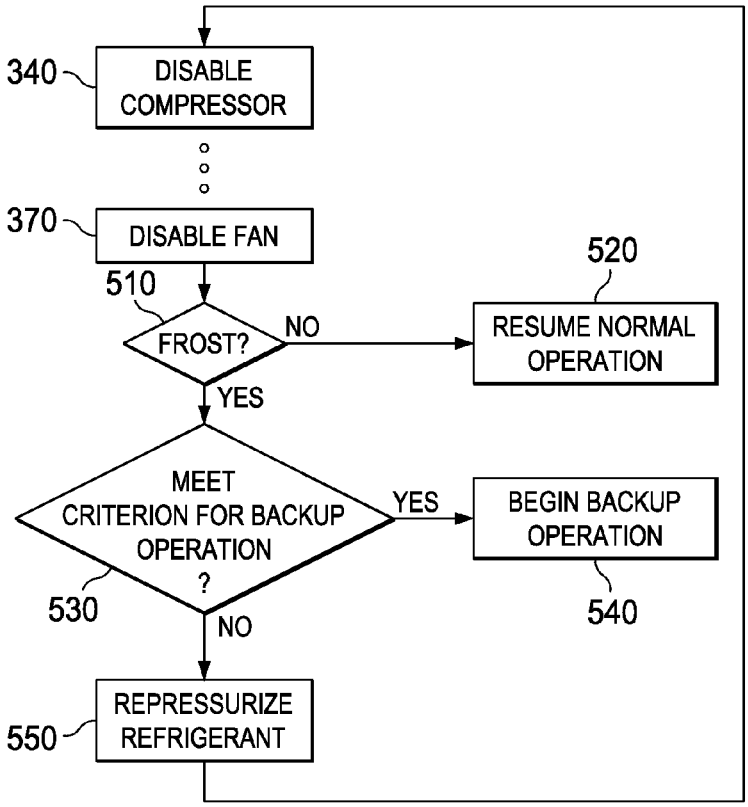
FIGS. 5 and 6 are flow diagrams of optional additional steps in the method of FIG. 3.

FIG. 5 illustrates optional steps that may be performed in the method 300. In a step 510, the system 100 determines if the frost 175 remains on the OD HX coil 105 after executing a passive defrost operation. If the system 100 fails to detect frost remaining on the OD HX coil 105, the method 300 branches to the step 520 and resumes normal operation. If instead the frost 175 is detected, then the method 300 advances to a step 530. This may occur for heavy frost accumulation or low outdoor temperature as described previously. In this situation, the controller 127 may determine if a criterion has been met to begin operation of a backup heat source, such as the backup heat source 170.

The criterion may be, e.g., having performed a maximum number of successive passive defrost operations in an attempt to remove the frost 175. For instance, in some cases, the frost 175 may not be melted by a maximum allowable number of single passive defrost operations. While in principle any number of passive defrost operations may be performed, the controller 127 may be configured to recognize that further attempts would be fruitless or impractical. Moreover, while a defrost is performed, no heat is provided to the ID ambient 120 without a backup source. Thus the number of defrost attempts may be limited to reduce discomfort to occupants of the ID ambient 120 and/or power consumed by supplemental heating. The maximum number may be a predetermined number, e.g., 3-5, or may be calculated dynamically as a function of, e.g., OAT and humidity.

Accordingly, if the controller 127 determines in the step 530 that the criterion for backup operation is met, the method 300 branches to a step 540. In the step 540, the controller 127 enters a backup heating mode. In this mode, the system 100 uses the backup heat source 170 to warm the ID ambient 120. The backup heating mode may continue until the criterion that was met in the step 530 is no longer met, as described further below. In the event that the controller 127 determines in the step 530 that the criterion has not been reached, then the method 300 advances to a step 550. In the step 550, the controller 127 enables the compressor 125 to repressurize the refrigerant. The compressor 125 may be operated long enough to ensure that the temperature of the refrigerant reaches a normal operating temperature. The method 300 then returns to the step 340, in which the compressor 125 is disabled to begin another defrost operation.

Figure 6:
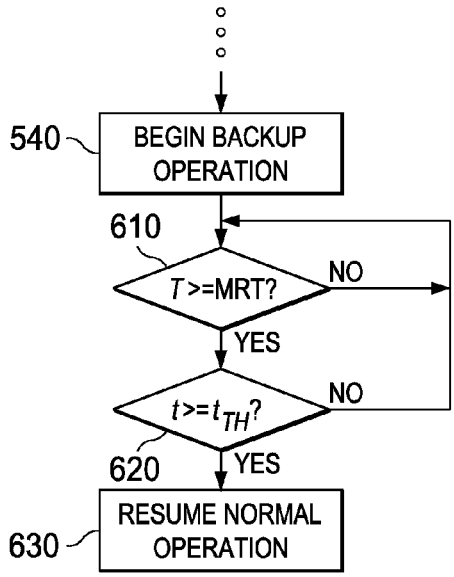

FIG. 6 illustrates optional steps of the method 300 to re-enable the pumped heating mode. The pumped heating mode may be re-enabled when the controller 127 determines that conditions conducive to heavy frosting are no longer present. In one embodiment, the end of heavy frost conditions is determined when the temperature of the OD ambient 110 rises above a minimum reset temperature (MRT). In an embodiment, several factors are considered in the determination. First, the OAT should be greater than the MRT. If not, the conditions that led to backup heating may again result in heavy frosting. The MRT should at least be greater than the temperature of the OD ambient 110 when the system 100 began backup heating. Generally, it is preferred that the MRT be above freezing, about 0 C. In some cases, it may be preferred that the MRT be at least about 1.5 C. Second, the time that the temperature is above the OAT may be considered. If the OAT is lower, a longer time above the MRT may be desirable to ensure frost formed during pumped heating operation may be removed by the passive defrost. On the other hand, if the OAT is higher, a shorter time may be needed.

In an illustrative embodiment, the MRT is 1.5° C. The controller 127 computes a running average of the difference between the temperature of the OD ambient 110 and 1.5° C. The averaging window may be, e.g., about one minute. The average is scaled by the number of hours that the OAT is greater than the MRT. When the scaled average reaches a threshold value of about 11° C.·hrs, then the passive defrost is re-enabled. Expressed concisely, $$(T_{avg}-1.5)*t\geq 11 \quad (1)$$

where t is the duration of the period of interest in hours, and $T_{avg}$ is the average temperature in Celsius during the period. The product computed in Eq. 11 is referred to herein as the time-temperature product.

A threshold time to resume pumped heating may thus be defined:

$$t_{TH} \geq \frac{11}{T_{avg}-1.5} \quad (2)$$

Thus, for example, the following conditions time thresholds would lead to re-enabling the system 100:

1 hour at an OD ambient temperature of 13° C.

4.5 hours at 4 C

Accordingly, in a step 610, the controller 127 determines if the temperature of the OAT is at or above the MRT. If the OAT is less than the MRT, then the method 300 loops to the step 610 and continues to monitor the OAT. If the OAT is at or above the MRT, then the method 300 advances to a step 620. In the step 620, the controller 127 determines the duration of the period during which the average OAT is at or above the MRT. If the duration is below the threshold value associated with the average OAT, then the method 300 returns to the step 610. If instead the duration is above the threshold value, the method 300 advances to the step 630, in which the controller 127 re-enables normal operation of the system 100, including the passive defrost.

In some cases, the OAT may rise above freezing and thereafter fall below freezing within a relatively short period, e.g., hours. In such cases, the time-temperature product accumulated during the time the OAT is above freezing may be cleared. When the OAT again rises above freezing, the time-temperature product accumulated beginning at zero. In this manner, the threshold time described above may provide a "guard band" to ensure that the passive defrost is not re-enabled until the OAT is favorable to reducing overall energy consumption through the use of the passive defrost. One of ordinary skill in the pertinent art will appreciate that the threshold values other than the example embodiment described above may be used without departing from the scope of the disclosure.

Figure 7:
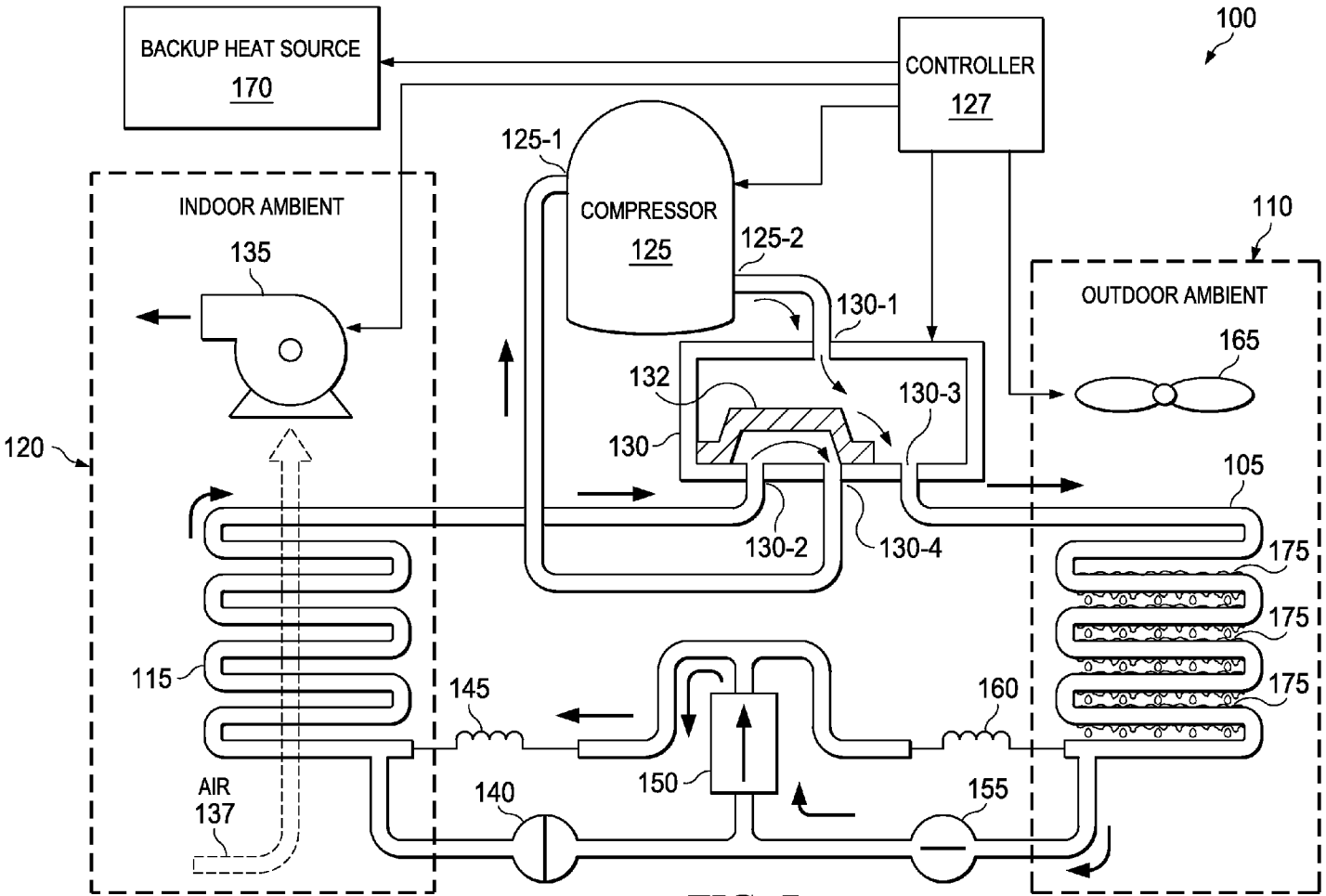
FIG. 7 illustrates the heat pump system of the disclosure configured to perform a reverse-cycle defrost.

Turning now to FIG. 7, illustrated is an embodiment of the disclosure in which the system 100 performs a reverse-cycle defrost. There may be cases in which a passive defrost is ineffective within an allowable time period or a number of defrost attempts. In the illustrated embodiment the controller 127 is configured to control operation of the system 100 to perform a conventional reverse-cycle defrost. The controller 127 may be configured to use the passive defrost and the reverse-cycle defrost in any combination as necessary to reduce the overall energy consumed by the system 100.

Operating the system 100 according the various embodiments advantageously results in a demonstrable increase of efficiency thereof. For example, in one test the heating seasonal performance factor (HSPF) of the system 100 increased from about 8.55 BTU/Wh using a conventional reverse-cycle defrost to about 8.73 BTU/Wh using the disclosed passive defrost. The HSPF test is described by the Air-Conditioning and Refrigeration Institute (ARI) standard 210/240, and takes into account the energy consumed by defrosting the coils. This increase in efficiency represents about 2% recovery of heat that would otherwise be lost to the OD ambient 110, and may be implemented with no additional hardware in the system 100.

Those skilled in the art to which this application relates will appreciate that other and further additions, deletions, substitutions and modifications may be made to the described embodiments.

What is claimed is:

1. A heat pump system, comprising:

a closed system including:

a condensing heat exchanger coil;

an evaporating heat exchanger coil;

a refrigerant; and a compressor configured to compress said refrigerant, thereby causing said refrigerant to have a greater pressure in said condensing heat exchanger coil than in said evaporating heat exchanger coil;

a flow valve having a plurality of ports and a reversing slide valve for directing the refrigerant with respect to the compressor; and a controller configured to perform a passive defrost of said evaporating heat exchanger coil that includes disabling said compressor and providing a low-resistance bypass path between said condensing and evaporating heat exchanger coils that bypasses said compressor, wherein the slide valve floats off of a valve seat within the flow valve thereby allowing said refrigerant to flow from said condensing heat exchanger coil to said evaporating heat exchanger coil while said compressor is disabled.

2. The system as recited in claim 1, wherein said compressor configures the reversing slide valve to provide said bypass path.

3. The system as recited in claim 1, further comprising a blower motor configured to cause air to flow over said condensing heat exchanger coil, wherein said controller is further configured to disable said blower motor while said compressor is disabled.

4. The system as recited in claim 1, further comprising a fan motor configured to cause air to flow over said evaporating heat exchanger coil, wherein said controller is further configured to disable said fan motor while said compressor is disabled.

5. The system as recited in claim 1, wherein said controller is further configured to perform a passive defrost each time a temperature set point of a heated ambient is reached.

6. The system as recited in claim 1, wherein said controller is further configured to enable operation of a backup heat source when said passive defrost fails to clear said evaporating heat exchanger coil of frost.

7. The system as recited in claim 1, wherein said controller is further configured to activate said reversing slide valve and enable a reverse-cycle defrost when said passive defrost fails to clear said evaporating heat exchanger coil of frost.

8. A method of manufacturing a heat pump system, comprising:

configuring a compressor to compress a refrigerant, thereby causing a pressure differential between said refrigerant in a condensing heat exchanger coil and in an evaporating heat exchanger coil, wherein a flow valve having a plurality of ports and a reversing slide valve directs the refrigerant with respect to said compressor; and configuring a controller to perform a passive defrost of said evaporating heat exchanger coil that includes disabling said compressor and providing a low-resistance bypass path between said condensing and evaporating heat exchanger coils that bypasses said bypasses said compressor, wherein said slide valve floats off of a valve seat comprising said flow valve thereby allowing said refrigerant to flow from said condensing heat exchanger coil to said evaporating heat exchanger coil while said compressor is disabled.

9. The method as recited in claim 8, wherein said passive defrost further includes configuring said reversing slide valve to provide said bypass path.

10. The method as recited in claim 8, further comprising configuring said controller to disable a blower motor configured to cause air to flow over said condensing heat exchanger coil during said passive defrost.

11. The method as recited in claim 8, further comprising configuring said controller to disable a fan motor configured to cause air to flow over said evaporating heat exchanger coil during said passive defrost.

12. The method as recited in claim 8, further comprising configuring said controller to perform a first passive defrost and a second passive defrost without operating said heat pump system in a pumped heating mode between said first and second passive defrost.

13. The method as recited in claim 8, further comprising configuring said controller to enable a backup heat source in the event that said passive defrost fails to remove frost from said evaporating heat exchanger coil.

14. The method as recited in claim 8, further comprising configuring said controller to enable a reverse-cycle defrost when said passive defrost fails to remove frost from said evaporating heat exchanger coil.

15. A controller configured to control an operation of a heat pump by the method comprising:

compressing a refrigerant with a compressor, thereby causing a pressure differential between said refrigerant in a condensing heat exchanger coil and in an evaporating heat exchanger coil, wherein a flow valve having a plurality of ports and a reversing slide valve directs the refrigerant with respect to said compressor; and performing a passive defrost of said evaporating heat exchanger coil that includes disabling said compressor and providing a low-resistance bypass path between said condensing and evaporating heat exchanger coils that bypasses said compressor, wherein said slide valve floats off of a valve seat comprising said flow valve thereby allowing said refrigerant to flow from said condensing heat exchanger coil to said evaporating heat exchanger coil while said compressor is disabled.

16. The controller as recited in claim 15, wherein said passive defrost further includes configuring said reversing slide valve to provide said bypass path.

17. The controller as recited in claim 15, further configured to disable a blower motor configured to cause air to flow over said condensing heat exchanger coil during said passive defrost.

18. The controller as recited in claim 15, further configured to disable a fan motor configured to cause air to flow over said evaporating heat exchanger coil during said passive defrost.

19. The controller as recited in claim 15, further configured to perform a first passive defrost and a second passive defrost without operating said heat pump system in a pumped heating mode between said first and second passive defrost.

20. The controller as recited in claim 15, further configured to enable a backup heat source in the event that said passive defrost fails to remove frost from said evaporating heat exchanger coil.

* * * * *